US008887452B2

(12) United States Patent
Carhart

(10) Patent No.: US 8,887,452 B2
(45) Date of Patent: Nov. 18, 2014

(54) APPARATUS AND METHOD FOR PROTECTING IN-GROUND WOOD

(76) Inventor: Kenneth C. Carhart, Sisters, OR (US)

( * ) Notice: Subject to any disclaimer, the term of this patent is extended or adjusted under 35 U.S.C. 154(b) by 181 days.

(21) Appl. No.: 13/525,498

(22) Filed: Jun. 18, 2012

(65) Prior Publication Data

US 2013/0333324 A1 Dec. 19, 2013

(51) Int. Cl.
*E04B 1/92* (2006.01)
*E04C 3/29* (2006.01)

(52) U.S. Cl.
USPC ..... 52/169.14; 52/169.13; 52/170; 52/835; 52/848

(58) Field of Classification Search
USPC ..... 52/169.13, 169.14, 170, 834, 835, 851, 52/853, 219, 848; 285/45, 148.24, 373, 285/419
See application file for complete search history.

(56) References Cited

U.S. PATENT DOCUMENTS

| | | | | | |
|---|---|---|---|---|---|
| 381,671 | A | * | 4/1888 | Brown | 52/835 |
| 837,820 | A | * | 12/1906 | Folsom et al. | 52/168 |
| 877,268 | A | * | 1/1908 | Van Buren | 52/165 |
| 1,419,108 | A | * | 6/1922 | Bitting | 52/168 |
| 1,596,657 | A | * | 8/1926 | Heber | 52/168 |
| 2,385,869 | A | * | 10/1945 | Lane | 405/216 |
| 2,452,047 | A | * | 10/1948 | Hamblin | 138/133 |
| 2,724,156 | A | * | 11/1955 | Shaw | 52/168 |
| 2,756,172 | A | * | 7/1956 | Kidd | 138/147 |
| 2,928,411 | A | * | 3/1960 | Johnson | 137/236.1 |
| 3,118,644 | A | * | 1/1964 | Wernig | 248/73 |
| 3,321,924 | A | * | 5/1967 | Liddell | 405/216 |
| 3,488,040 | A | * | 1/1970 | Dickson | 138/155 |
| 3,592,428 | A | * | 7/1971 | McFarlane | 248/64 |
| 3,890,795 | A | * | 6/1975 | Maurer | 405/216 |
| 3,997,149 | A | * | 12/1976 | Stout | 267/140 |
| 4,023,374 | A | * | 5/1977 | Colbert et al. | 405/216 |
| 4,068,483 | A | * | 1/1978 | Papworth | 405/216 |
| 4,203,476 | A | * | 5/1980 | Vitellaro | 138/122 |
| 4,283,161 | A | * | 8/1981 | Evans et al. | 405/216 |
| 4,543,757 | A | * | 10/1985 | Cosgrove | 52/295 |
| 4,714,280 | A | * | 12/1987 | Winterhoff | 285/381.4 |
| 4,779,389 | A | * | 10/1988 | Landers | 52/169.13 |
| 4,799,340 | A | * | 1/1989 | Lichau et al. | 52/170 |
| 5,044,821 | A | * | 9/1991 | Johnsen | 405/50 |
| 5,060,416 | A | * | 10/1991 | Rohde | 47/32.6 |
| 5,222,325 | A | * | 6/1993 | Angus | 47/30 |
| 5,311,713 | A | * | 5/1994 | Goodrich | 52/301 |
| 5,435,667 | A | * | 7/1995 | Strange | 405/216 |
| 5,479,741 | A | * | 1/1996 | Underwood | 47/30 |
| 5,516,236 | A | * | 5/1996 | Williams et al. | 405/216 |
| 5,571,229 | A | * | 11/1996 | Fitzsimmons et al. | 473/481 |
| 5,591,263 | A | * | 1/1997 | Chin et al. | 118/200 |

(Continued)

OTHER PUBLICATIONS

Copending U.S. Appl. No. 13/214,171, having the same inventor.

*Primary Examiner* — Robert Canfield
*Assistant Examiner* — Charissa Ahmad
(74) *Attorney, Agent, or Firm* — Hancock Hughey LLP

(57) ABSTRACT

An apparatus and method for decreasing rot and insect damage to in-ground wood increases the effective life of the wood. A waterproof collar has an upper margin that defines a seal against the wood and the collar surrounds the wood from a point above the ground level to a predetermined location below the ground level. The collar defines a barrier that prevents microbes and insects from gaining access to the wood over the most important portion of the wood in terms of structural integrity, the critical decay zone.

10 Claims, 3 Drawing Sheets

(56) References Cited

U.S. PATENT DOCUMENTS

| | | | | |
|---|---|---|---|---|
| 5,685,522 | A * | 11/1997 | Randolph, Jr. | 256/1 |
| 5,704,580 | A * | 1/1998 | Peery, Jr. | 248/345 |
| 5,752,349 | A * | 5/1998 | Fitzsimmons et al. | 52/165 |
| 5,765,880 | A * | 6/1998 | Goddard | 285/231 |
| 5,775,839 | A * | 7/1998 | Mazzer | 405/50 |
| 5,832,675 | A * | 11/1998 | Zuares | 52/60 |
| 5,901,525 | A * | 5/1999 | Doeringer et al. | 52/835 |
| 6,041,559 | A * | 3/2000 | Schickert et al. | 52/165 |
| 6,062,342 | A * | 5/2000 | Dobson | 182/230 |
| 6,073,416 | A * | 6/2000 | Peter | 52/835 |
| 6,098,351 | A * | 8/2000 | Mills | 52/169.14 |
| 6,244,781 | B1 * | 6/2001 | Roller | 404/6 |
| 6,256,961 | B1 * | 7/2001 | Byrnes | 52/835 |
| 6,257,557 | B1 * | 7/2001 | Anderson et al. | 256/1 |
| 6,364,575 | B1 * | 4/2002 | Bradley et al. | 405/216 |
| 6,391,414 | B1 * | 5/2002 | Hjertman et al. | 428/36.9 |
| 7,275,349 | B2 * | 10/2007 | Auman | 52/514 |
| 7,325,790 | B2 * | 2/2008 | Lee | 256/65.14 |
| 7,470,091 | B2 * | 12/2008 | Scholl | 405/231 |
| 7,762,016 | B2 * | 7/2010 | Davidson | 40/607.01 |
| 7,827,762 | B2 * | 11/2010 | Griffiths | 52/834 |
| 8,256,184 | B2 * | 9/2012 | Lowe | 52/741.3 |
| 8,485,493 | B2 * | 7/2013 | Wells et al. | 249/48 |
| 8,533,991 | B2 * | 9/2013 | Lais et al. | 47/32.4 |
| 2006/0150572 | A1 * | 7/2006 | Rawson-Harris | 52/736.2 |
| 2007/0193203 | A1 * | 8/2007 | Prenn | 52/736.4 |
| 2008/0072510 | A1 * | 3/2008 | Wells et al. | 52/251 |
| 2009/0025336 | A1 * | 1/2009 | Prenn | 52/835 |
| 2012/0011804 | A1 * | 1/2012 | Winterhalter et al. | 52/834 |
| 2013/0042547 | A1 * | 2/2013 | Carhart | 52/169.13 |

* cited by examiner

APPARATUS AND METHOD FOR PROTECTING IN-GROUND WOOD

TECHNICAL FIELD

The present invention relates to an apparatus and method for decreasing rot and insect damage to in-ground wood and thereby increasing the effective life of the wood, and more specifically relates to a barrier system for in-ground wood that prevents microbes and insects from gaining access to the wood in order to prevent rot at the most critical structural portion of the wood.

BACKGROUND

Wooden poles of a variety of descriptions are sunk into the ground for use as supports. Examples include posts for fencing, supports for decking and other structures, and utility poles. Wooden poles are used as fence posts for many different styles of fences because they are both highly functional and often very attractive. Although there are many techniques for building fencing using wooden posts, in a typical situation the post is sunk into the ground, typically in a pre-drilled or pre-dug hole, which is then filled in with soil, gravel or concrete. Some type of railing is then attached to the poles to complete the fencing.

The effective life of in-ground wood such as a wooden fence post depends on a variety of factors, including for instance the species of wood that is used, the soil conditions including the amount of moisture in the soil and the composition of the soil—microbial-caused decomposition of wood fiber eventually results in rot and insect damage can further weaken the posts. While some species of wood such as some types of cedar are notoriously long-lasting as fencing posts, all in-ground wood will eventually decompose and the post will therefore fail and need to be replaced. In some areas where there is significant moisture in the ground, wooden fence posts can fail in a matter of years from the combination of bacterial and other microbial decomposition of the wood and insect damage.

Treated wooden fencing has significantly improved the longevity of in-ground wooden posts. Treating wooden posts involves applying preservatives of various types to the wood so that microbial and insect degradation of the wood fibers is slowed or stopped. Treatments can include simple application of liquid preservatives, and more complicated processes that involve applying preservatives to the wood under pressure so that the preservatives penetrate into the wood.

Regardless of the way in which the wood is treated, the preservatives that are used often contain dangerous and toxic chemicals that could be harmful to health, or at least raise questions about their proper use in the environment. When pressure treated wood is used for in-ground applications such as fence posts, some of the chemicals used as preservatives can leach into the soil and the United States Environmental Protection Agency recommends that wood treated with the commonly used preservative chromated copper arsenate ("CCA") should not be used in proximity to edible plants.

For these and a variety of other reasons, more and more consumers are questioning use of products that add such toxins to the soil and are therefore seeking out alternatives to use of treated wood. Yet, non-treated wood decays at a more rapid rate than its treated counterpart so treated posts and the like are very commonly used. The consumer must therefore make a decision by balancing the risks of using treated wood versus the possible environmental concerns, and the relatively lesser life span of untreated wood. Regardless of whether a consumer uses treated or untreated wood, there is a need for apparatus and systems that enhance the effective life of in-ground wood such as posts and the like. And if a development allows a greater life span for treated and untreated wood, the consumer has more options to consider in making a decision on what type of wood to use.

The present invention provides an apparatus and method for addressing the problems of rapid wood decay to thereby extend the life of in-ground wood by reducing the rate at which the wood fails due to rot. The invention facilitates improved longevity of in-ground wood and may be used with both treated and untreated wood.

Studies have shown that the portion of an in-ground post that is near the surface of the ground is the most susceptible to rapid wood decay and subsequent failure of the wood. While decay is known to occur throughout in-ground wood where environmental conditions favor microbial action, it is at the "critical decay zone" near the ground surface that comprises the first several inches of the wood that is below the ground surface where wood failure most often occurs. Thus, when an in-ground post fails, the point of failure is most likely in the critical decay zone. Accordingly, one way to effectively increase the longevity of in-ground wood is to protect the portion of the wood that resides in this critical decay zone and to inhibit rot that occurs in this zone.

The present invention is defined by a waterproof collar that surrounds the post below ground level in the critical decay zone and extends to a level just above ground level. The collar defines a barrier between the post and surrounding soil that prevents migration of water across the barrier, prevents microbes in the soil from gaining access to the wood and associated decomposition, and prevents insects from gaining access to the wood. The collar is a linear member that is cut to length wrapped around the post to encircle it. The collar is secured in place around the post and a deformable inwardly projecting upper ridge seals against the post when the collar is sealed in place. Two or more lengths of collar may be overlapped where a wider zone of protection is deemed necessary and an interlock feature of the invention connects the two lengths of collar together securely.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF ILLUSTRATED EMBODIMENTS

Figure 1:
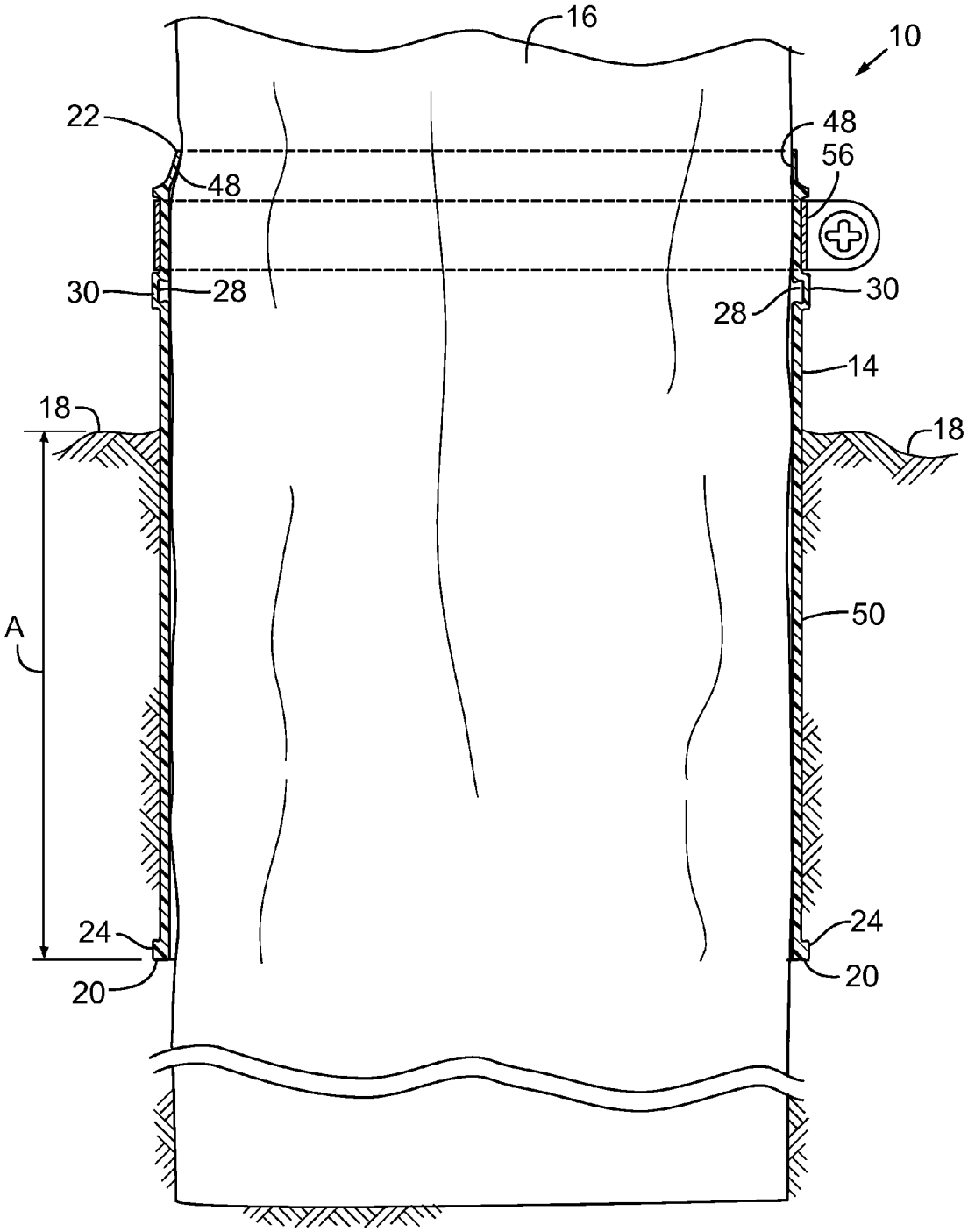
FIG. 1 is an elevational and partial cross sectional view of an exemplary in-ground fence post illustrating the collar according to the present invention, wherein the collar has been applied to the post in the critical decay zone.

A first illustrated embodiment of an apparatus 10 for protecting in-ground wood according to the present invention is illustrated in FIGS. 1 through 5. As noted previously, the apparatus 10 according to the present invention comprises a collar 14 that surrounds a fence post, which is identified herein with reference number 16. Relative directional terms are used at times to describe parts of the invention and relative positions of the parts. As a naming convention, the ground plane is considered to be the surface of the ground (reference number 18) and, for purposes herein, is considered to be horizontal although of course in use the ground plane has slope and irregularities. Other relative directional terms correspond to this convention: "upper" refers to the direction above and away from the ground plane; "lower" is generally in the opposite direction, "inward" is the direction from the exterior of the post toward the axial center of the post, and so on.

The invention is described with reference to use of the invention with an in-ground fence post. It will nonetheless be appreciated that the invention is not limited to use with fence posts but instead may be used with any type and size of in-ground wood, such as deck supports, telephone and utility poles, and the like. The posts may have any cross sectional configuration, such as square, round, or irregular.

Collar 14 defines a length of elongate collar material that is adapted to be wrapped around and to thereby surround post 16 immediately above ground level 18 and extending to a point below the ground level. The collar is secured to the post as detailed below. The width of the collar 14 is sufficient to encircle and surround or cover post 16 over the entire width of the "critical decay zone." As alluded to above, the critical decay zone is that portion of the ground that extends from the ground level a certain distance into the ground where a post is most likely to fail. There is no precise width or depth of the critical decay zone and use of the phrase herein is not meant to be limiting—the depth of the critical decay zone will vary from location to location and depends on many environmental factors, including but not limited to soil conditions and make-up, moisture conditions, bacterial and other microbial life specific to an area, etc. As used herein therefore, the term "critical decay zone" is meant to be a reference to that portion of the ground that extends from near the surface to the depth above which most posts in a given area are likely to fail. In FIG. 1, the critical decay zone is illustrated with length A—it extends from the surface of ground 18 to a point above the lowermost edge 20 of collar 14. It will be understood that in many areas the width of collar 14 is sufficient to cover post 16 over the entire critical decay zone—this is the situation shown in FIG. 1. It will also be understood that in some areas the critical decay zone may be wider than shown in FIG. 1 and therefore that the width of the critical decay zone is greater than the width of a single collar 14. This is the situation shown in FIG. 5 and described below where two (or more) collars 14 are used to cover the post 16 over the entire critical decay zone. Another alternative in such situations is to use a single collar that has an increased width.

Nominally, it has been found that the overall width of collar 14 of between about 8 to 16 inches is sufficient to provide protection over the critical decay zone in most locations, with the preferred width about 14 inches. Thus, with reference to FIG. 1, in the preferred embodiment the distance from the lowermost edge 20 of collar 14 to the uppermost edge 22 is about 14 inches—about 2 inches of the collar 14 extends above the ground level 18 and about 12 inches of the collar covers the post 16 below ground level. As noted, these dimensions are exemplary only and are not limiting.

Figure 2:
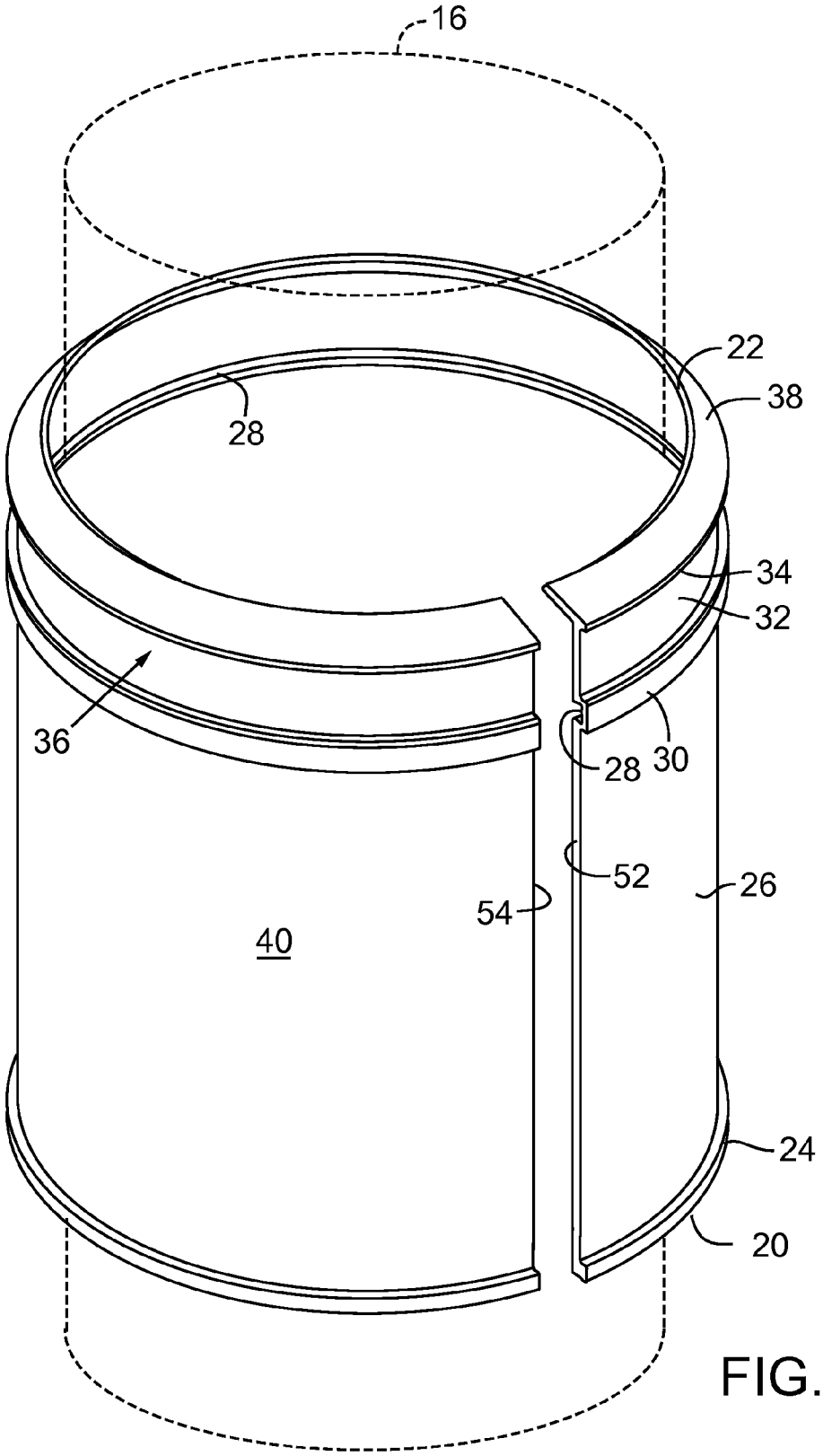
FIG. 2 is a perspective view of an illustrated embodiment of the collar according to the present invention.
Figure 3:
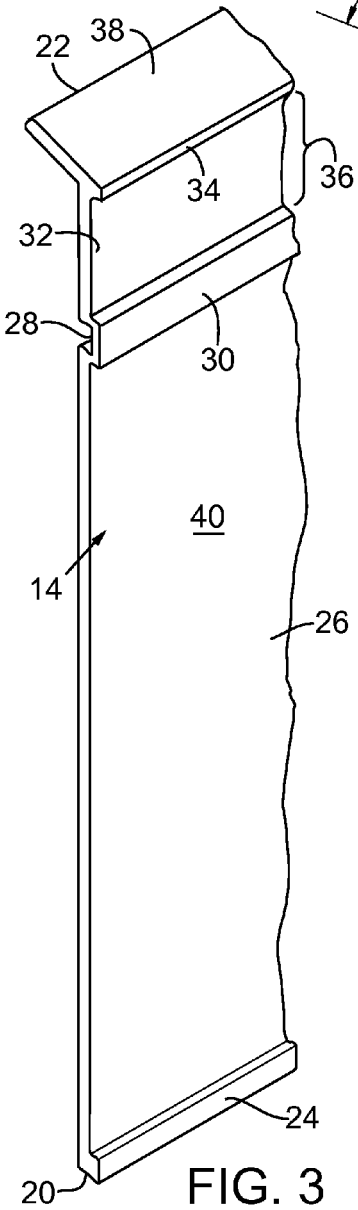
FIG. 3 is a perspective view of a section of the collar illustrated in FIG. 2.
Figure 4:
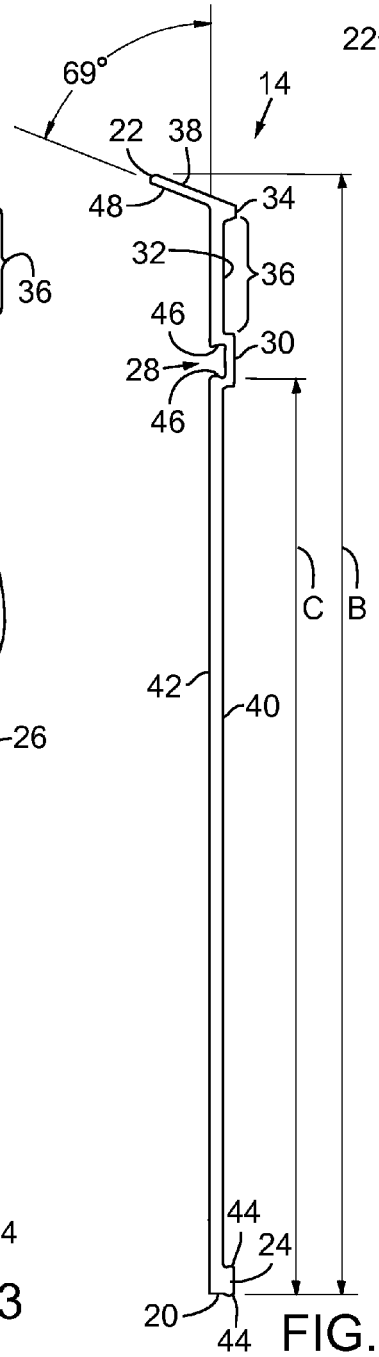
FIG. 4 is an end elevation view of the collar shown in FIG. 3.

As shown in FIGS. 2 through 4, collar 14 is defined by an elongate length of material that is wrapped around the post 16—the lineal length of collar 14 is roughly equal to the circumference around post 16 where the collar surrounds the post.

With specific reference to FIG. 2 and beginning with the lowermost edge 20 of collar 14, a lip or ridge 24 extends outwardly from the sidewall 26 adjacent the lowermost edge 20. Sidewall 26 defines the main body section of the collar 14 and, as may be seen with the collar 14 shown in FIG. 3, the sidewall 26 defines a substantially planar member, and which is oriented vertically when a post 16 is oriented vertically in the ground. As detailed below, ridge 24 is sized to matingly engage with a channel 28 that is defined by on the inner surface of the collar and which mirrors the outwardly projecting ridge 30. Immediately adjacent and above ridge 30 is a vertical sidewall section 32 that defines a circumferential seat for a fastener band that attaches the collar 14 to the post. Vertical sidewall section 32 terminates at an outwardly projecting ridge 34 at the upper extent of the vertical sidewall section 32. The combined ridge 30, vertical sidewall section 32 and upper outwardly projecting ridge 34 at opposite sides of the vertical sidewall section 32 effectively define a circumferential groove 36 around which the connecting band extends (i.e., "circumferential" when apparatus 10 is used with a cylindrical post)—the ridges 30 and 34 help to guide the fastener into place and to retain the fastener in position, as detailed below.

Above vertical section 32 and outwardly projecting ridge 34 is an inwardly and upwardly sloping section, referred to herein as sealing section 38. As detailed below, sealing section 38 defines a seal between collar 14 and the post 16 in the assembled apparatus 10.

Figure 5:
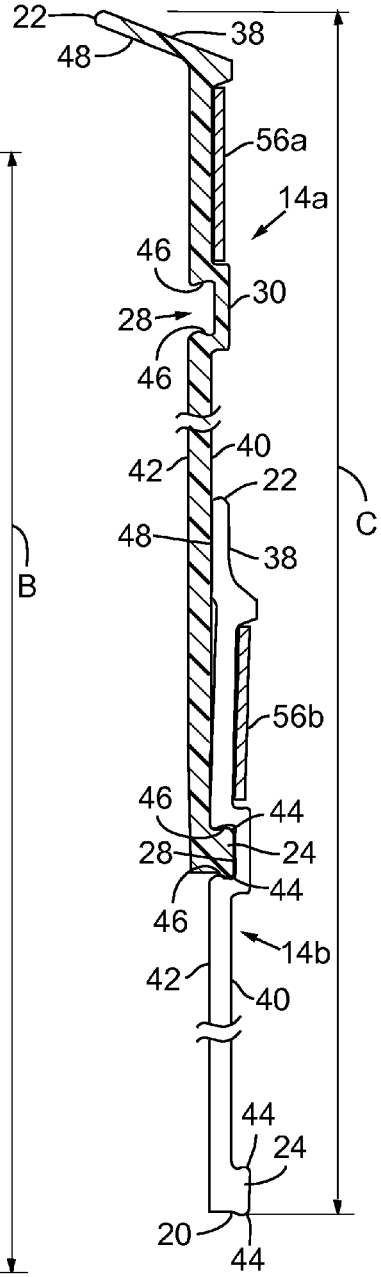
FIG. 5 is a partial cross sectional view illustrating an alternative use of the collar according to the present invention, and more specifically, use of two collars that are interconnected with an interlock system that secures the two lengths of collar together.

Turning now to FIGS. 3, 4 and 5, as noted above outwardly projecting ridge 30 mirrors a channel 28 that extends along collar 14 on the surface 42 of the collar. A longitudinal axis along the channel 28 is coaxial with a longitudinal axis extending along the ridge 30. The interior dimensions of channel 28 correspond to the exterior dimensions of ridge 24 so that when two lengths of collar 14 are overlapped, the ridge 24 of one length of collar may be mated and interlocked with the channel 28 in the other length of collar and to thereby interconnect the two lengths of collar 14 when the two lengths are overlapped. As detailed below, this interconnection between two pieces of collar defines a strong connection. As best shown in FIGS. 4 and 5, the outer edges 44 of ridge 24 may define slight outward bulges and the inner upper and lower walls 46 of channel 28 may bulge slightly inwardly toward the center of the channel. Preferably, the width of ridge 20 between edges 44 is slightly greater than the width of channel 28 between walls 46 at the bulges just mentioned.

For reference purposes, the exterior surface of collar 14 is identified in the drawings with reference number 40—the exterior surface 40 is exposed to the elements when the collar is in place around a post 16. The opposite surface of collar 14, that is, the surface that faces post 16 is identified as interior surface 42 (see FIG. 4).

Collar 14 is formed from a flexible, malleable and somewhat elastic material that is waterproof and resistant to degradation from ultraviolet radiation. A thermoplastic elastomer sold under the brand name SANTOPRENE is one material that has found to exhibit good properties for use in collar 14, especially because SANTOPRENE is a fully recyclable material. While a variety of colors may be used for collar 14, the preferred color is black. The collar is provided in an extruded roll and the collar is cut to an appropriate length by the installer; the lineal length of the collar 14 as used with a post 16 is the same as or slightly greater than the circumference of the post where the collar surrounds the post just above the level of ground 18, as shown in FIG. 1, and extending downwardly into the ground over the critical decay zone A.

With specific reference to FIG. 4, preferred but exemplary specifications for collar 14 are detailed, although it will be understood as previously detailed that the size, shape and form of the collar may be varied as required in any given installation. The overall height of collar 14 is represented as dimension B, and as noted is preferably approximately 14 inches. The overall height of collar 14 between the lower edge 20 and the lowermost edge of ridge 30 is shown as dimension C. Sealing section 38 is angled at about a 69 degree angle from the vertical sidewall 26.

Returning to FIG. 1, apparatus 10 is illustrated installed on a post 16. Initially, a hole 50 is dug in the ground with the appropriate diameter for the post 16 that will be inserted into the hole, and at the proper depth. The installer also determines the critical decay zone A depth for the location and a collar 14 having the appropriate dimension B is selected.

The circumference of post 16 immediately above the level of ground 18 when the post is inserted into the ground is then measured and a length of collar 14 is cut to the length of the circumference, or slightly greater. This is best shown in FIG. 2 where the length of collar 12 has opposite ends 52 and 54. The collar 12 is then wrapped around the post 16 and is then pulled snug around the post 16 and the ends 52 and 54 are mated to one another (and if the length of the piece of collar 14 is longer than the circumference of the post, the ends 52 and 54 are overlapped over one another) and the collar 14 may then optionally be held temporarily in place with a staple or tack (not shown). The collar is positioned along the length of the post so that the entire critical decay zone is covered with a minor portion of the collar above the ground level 18 and a major portion of the collar below ground level.

A fastener 56 is then wrapped around the collar 14 at circumferential sidewall channel 32 between ridges 30 and 34 and is tightened in place. It will be appreciated that the channel 32 between ridges 30 and 34 defines a circumferential seat for receiving the fastener 56 and that the ridges on opposite sides of the seat both help guide the fastener into place, and help to retain the fastener in position relative to the collar. There are numerous types of fasteners that will work for fastener 56. In FIG. 1, fastener 56 is a standard hose clamp of the type having a screw-driven worm gear that interconnects the ends and allows the clamp to be tightened. Other suitable fasteners include conventional nylon cable ties and zip ties, lap joint clamps, etc. The fastener 56 is tightened around the collar 14 and the post 16 to hold the collar securely in place on the post.

As an alternative method of attaching collar 14 to post 16, the opposite ends 52 and 54 of the collar may be tacked or stapled to the underlying post and the fastener 56 may be omitted.

As best illustrated in FIG. 1, when the collar 14 is secured in place on post 16 with a fastener 56, the inwardly projecting seal 38 adjacent the upper edge 22 of the collar is deflected upwardly out of its normally angled position relative to the sidewall of the collar when the collar is not attached to a post (e.g., FIGS. 2, 3 and 4) so that the interior surface 48 of the seal 38 rests flush against the surface of the post 16 and the seal 38 is compressed against the post. As noted, the collar and seal 38 are resilient. As such, when the collar is attached to the post the seal continues to be resiliently urged against the post, toward its normally angled position. In addition, the interior surface of the collar opposite fastener 56 lies flush against the surface of the post with the fastener 56 compressing the collar material tightly against the post. The fastener 56 shown in FIG. 1 is located above ground level 18. However, there is no set position for the fastener and it may be below ground level as well.

All wooden posts will have irregularities in their outer surfaces. However, because the collar 14 is malleable and flexible, the combination of the collar-to-post contact at seal 38 and the collar-to-post contact beneath the fastener 56, the collar effectively seals around the post at the upper end of the collar.

The collar 14 defines an effective apparatus and method for enhancing the life of in-ground wood because it inhibits the exposure of the post 16 to soil and water over the critical decay zone A. Said another way, the collar 14 defines a barrier to microbes and insects in the soil so that the microbes and insects cannot cause rot and other damage in the wood.

It is known that all wooden posts shrink and swell over time and as environmental conditions change. And as a practical matter, many posts are wet when they are installed and thus are likely to have a lesser circumference as they dry over time. Because the collar 14 is malleable and preferably has at least some elastic properties, it maintains an effective seal around the post even when the post has shrunk. This prevents organic material and organisms from gaining access to the wood beneath the collar. And when a hose clamp fastener 56 is used to attach the collar to the post, the clamp is strong enough to withstand pressure caused by swelling of the post without breaking. More specifically, the seal defined by seal 38 when the collar 14 is applied to a wooden post defines a very effective seal even during expansion and contraction of the wood.

As noted above, in some locations the depth of critical decay zone A may be greater than the overall height dimension (dimension B, FIG. 4) of collar 14. In these situations two pieces of collar 14 may be used to insure that the post 16 is protected over the entire critical decay zone.

With reference to FIG. 5, two lengths of collar 14 (14*a* and 14*b* respectively in FIG. 5) have been overlapped onto one another with the lowermost collar 14*b* extending over the upper collar 14*a*. That is, the inner surface 42 of collar 14*b* is facing the outer surface 40 of collar 14*a* and the inner surface 48 of sealing section 30 lies flush against outer surface 40 of collar 14*a*. When overlapped in this manner, the outwardly projecting ridge 24 of collar 14*a* is received in the channel 28 of collar 14*b* such that the bulges 44 on ridge 24 mate with the bulges 46 of channel 28 and the mated collars are thus interconnected by these mating structures. Because the collar material is malleable and resilient and the width of ridge 20 at bulges 44 is slightly greater than the width of the channel at bulges 46, there is a relatively tight connection between collars 14 and 14*b*. Preferably, two fasteners 56*a* and 56*b* are utilized, one for each collar 14*a* and 14*b*, respectively.

The combined height of the interconnected collars 14*a* and 14*b* is the distance of dimensions B+C; which the installer will have previously determined to be greater than the width of the critical decay zone A. It will be recognized that the ridge 24 and channel 28/ridge 30 may be placed at locations on sidewall 26 other than those shown in the figures.

In some instances it may be desirable to include a fastener 56 around collar 14 immediately adjacent ridge 24 at the lowermost edge of the collar, for example, when the post 16 is being installed with a "post pounder," which is a device that pounds the post into the ground without first digging a hole 50—typically the lower end of the post used in these applications may be pointed to ease pounding into the ground. Moreover, in some instances where two collars such as 14*a* and 14*b* are being used, it is possible to secure both collars to the post with only a single fastener 56*b* since that fastener compresses both collars 14*a* and 14*b* to the post. In this situation backfilled material will further compress the upper collar 14*a* against the post 16.

It will be readily apparent that even with the sealing functions provided by sealing section 38 pressed against the post, and the compression of collar material against the post by fastener 56, given the irregularities of the surface of wood posts and the porosity of wood, some external water will be able to make its way into the wood within the collar itself. But just as well, the water that enters is also able to evaporate. Moreover, the water that enters, such as rain water and irrigation water, is not combined with microbes and because the collar 14 defines a barrier between wood and soil, microbes that are in the soil cannot access the wood.

It will be appreciated by those of skill in the art that a variety of structural changes may be made to the sleeve and collar relative to the embodiments disclosed above without departing from the nature and scope of the invention.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. Apparatus for use with a wooden in-ground post to define a barrier between the ground and the post, comprising:

a one-piece malleable and flexible waterproof elongate collar adapted to be wrapped around said post, said collar defined by a lower edge and an upper edge and a main body portion therebetween, said main body portion defining a substantially planar sidewall having a first interior surface between said upper and lower edges and adapted for contacting the post when the collar is wrapped around said post so that the first interior surface is in contact with said post, and a sealing member extending along the upper edge that is adapted to define a seal between the collar and the post when the collar is wrapped around said post, wherein said sealing member is defined by a portion of the elongate collar that is adjacent said upper edge and in which in a first position when the collar is separated from said post is oriented at an acute angle relative to the plane defined by the body sidewall, and wherein when said collar is wrapped around said post said sealing member is deformed into a second position in which said sealing member is compressed against the post to define a seal between the post and the collar;

wherein said collar has opposite ends that are aligned when the collar is wrapped around said post, and including a seat extending along said main body portion adjacent said sealing member, said seat defined by an uninterrupted groove between opposed first and second elongate ridges that extend parallel to one another along said main body portion so that when said collar is wrapped around said post and the opposite ends are aligned the groove is continuous around said collar, and wherein said seat is adapted for receiving a fastener, said collar defining a second surface opposite said first interior surface, and wherein the first and second elongate ridges extend from the second surface and the first ridge is adjacent said sealing member; and an elongate channel extending along the first surface parallel to the first and second ridges on said second surface, said elongate channel having opposed upper and lower walls that include bulges that extend inwardly toward a central longitudinal axis extending along said elongate channel to define a channel width between the bulges.

2. The apparatus according to claim 1 including a third elongate ridge extending along the second surface adjacent the lower edge of said main body portion and said third elongate ridge being parallel to the second elongate ridge, said third elongate ridge defined by outer walls that include bulges that extend outwardly away from a central longitudinal axis extending along said third elongate ridge to define a ridge width between said bulges.

3. The apparatus according to claim 2 wherein the third elongate ridge is of a size capable of being received within the elongate channel.

4. The apparatus according to claim 3 wherein the ridge width is greater than the channel width and wherein a first upper collar may be paired with a second lower collar wherein the second lower collar is overlapped onto the first upper collar such that the third elongate ridge of the first upper collar is inserted into the elongate channel in the second lower collar to thereby interlock the first upper collar with the second lower collar.

5. The apparatus according to claim 3 in combination with a post, wherein when said collar is wrapped around said post and said post is inserted into the ground, the surface of said ground defining a ground level, a major portion of said collar is located below said ground level and a minor portion of said collar is located above said ground level.

6. The apparatus according to claim 5 wherein said post has a diameter and the diameter is subject to changes over time, and where when said collar is wrapped around said post and fastened thereto, said sealing member is compressed against said post and is deflected away from its normally oriented angle relative to the plane defined by the body sidewall and thereby defines a seal between said post and said collar, and wherein said seal between said post and said collar remains effective as the post diameter changes.

7. Apparatus for use with a wooden in-ground post in combination with a wooden in-ground post, comprising:

a one-piece waterproof elongate collar having a lower edge and an upper edge and a main body portion therebetween, said main body portion defining a substantially planar sidewall having an interior surface that is substantially entirely in contact with said post, and said collar further comprising flexible and resilient sealing means for defining a seal between the upper edge of said collar and the post when the collar is wrapped around the post and maintaining said seal as a diameter of said post increases and decreases;

an elongate channel extending continuously around the interior surface of said collar and having opposed upper and lower walls that include bulges that extend inwardly toward a central longitudinal axis extending along said elongate channel to define a channel width between the bulges;

wherein when said post is inserted into the ground, the surface of said ground defining a ground level, a major portion of said collar is located below said ground level and a minor portion of said collar is located above said ground level so that the collar defines a barrier between the ground and the post.

8. The apparatus according to claim 7 wherein the flexible and resilient sealing means further comprises an elongate sealing member extending along the upper edge of said collar having a planar inner surface that in a first position when the collar is not wrapped around the post is oriented at an inwardly oriented acute angle relative to a the plane defined by the body portion and in a second position when the collar is wrapped around the post is deformed so that said sealing member is compressed against said post and the planar inner surface is substantially parallel to the plane defined by the body portion.

9. The apparatus according to claim 8 including a seat extending along said main body portion adjacent said sealing member, said seat defined by an uninterrupted groove between opposed first and second elongate ridges that extend parallel to one another along said sidewall and wherein said seat is adapted for receiving a fastener.

10. The apparatus according to claim 9 wherein the sealing means forms a seal between said collar and said post.

* * * * *